US005528995A

United States Patent [19]

Lim

[11] Patent Number: 5,528,995

[45] Date of Patent: Jun. 25, 1996

[54] PALLET

[76] Inventor: Chow P. Lim, 151 Jalan Kenanga, Taman Udajaya, Selangor Darul Ehsan, Malaysia, 68000

[21] Appl. No.: 223,628

[22] Filed: Apr. 1, 1994

[30] Foreign Application Priority Data

Apr. 5, 1993 [MY] Malaysia ..... PI 9300610

[51] Int. Cl.[6] ..... B65D 19/26

[52] U.S. Cl. ..... 108/56.1; 108/51.3; 108/56.3; 206/599

[58] Field of Search ..... 108/56.1, 51.3, 108/51.1, 56.3; 229/120.32, 198.2; 206/599, 600, 386

[56] References Cited

U.S. PATENT DOCUMENTS

| | | | |
|---|---|---|---|
| 2,631,724 | 3/1953 | Wright | 108/51.3 X |
| 2,888,221 | 5/1959 | Connelly | 108/56.3 X |
| 2,908,464 | 10/1959 | Traudt et al. | 108/51.3 |
| 2,925,978 | 2/1960 | Marso | 108/56.3 X |
| 2,953,339 | 9/1960 | Roshon | 108/56.3 X |
| 3,464,370 | 9/1969 | Martin | 108/51.3 |
| 3,683,823 | 8/1972 | Schmid | 108/56.1 X |
| 3,763,791 | 10/1973 | Wilcox | 108/51.3 |
| 4,429,486 | 2/1984 | Bjornstad | 229/198.2 X |
| 4,433,807 | 2/1984 | Ganz | 229/198.2 |
| 4,600,140 | 7/1986 | Milliens | 229/198.2 |
| 4,632,345 | 12/1986 | Barley | 312/259 X |
| 4,685,401 | 8/1987 | Sheffer | 108/56.3 X |
| 4,723,699 | 2/1988 | Brown et al. | 229/198.2 |
| 4,875,419 | 10/1989 | Helton et al. | 108/51.3 X |

FOREIGN PATENT DOCUMENTS

| | | | |
|---|---|---|---|
| 598540 | 5/1994 | European Pat. Off. | 108/51.3 |
| 4018141 | 5/1991 | Germany | 108/51.3 |

*Primary Examiner*—Laurie K. Cranmer
*Assistant Examiner*—Janet M. Wilkens
*Attorney, Agent, or Firm*—Townsend and Townsend and Crew

[57] ABSTRACT

A pallet comprising a first sheet member (10) and a second sheet member (12), and a plurality of spacer elements (40) between the sheet members (10, 12). The sheet members (10, 12) and spacer elements (40) each have interengageable tongues (18) and slots (42) respectively carried by the members (10, 12) or elements (40). Each tongue (18) includes at least one flange (28) for securing the member (10, 12) or element (40) on insertion through the slot (42).

9 Claims, 14 Drawing Sheets

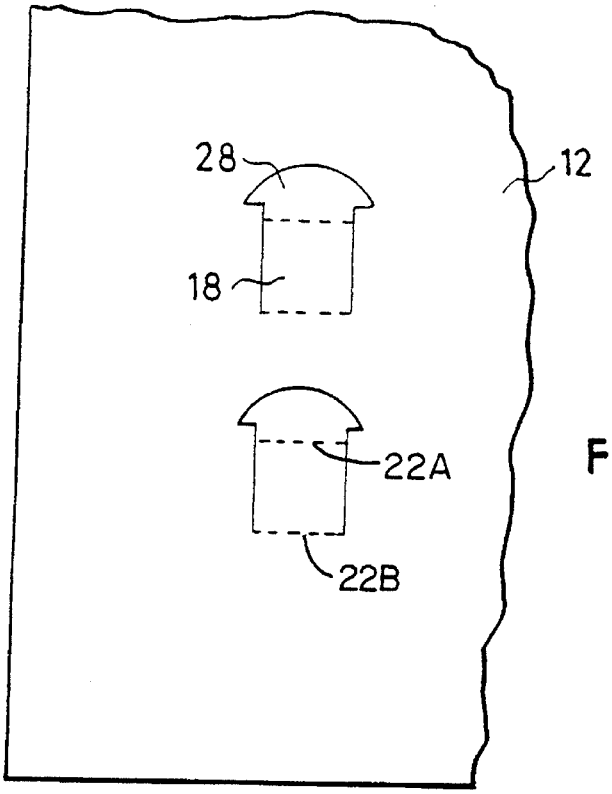
FIG 5A
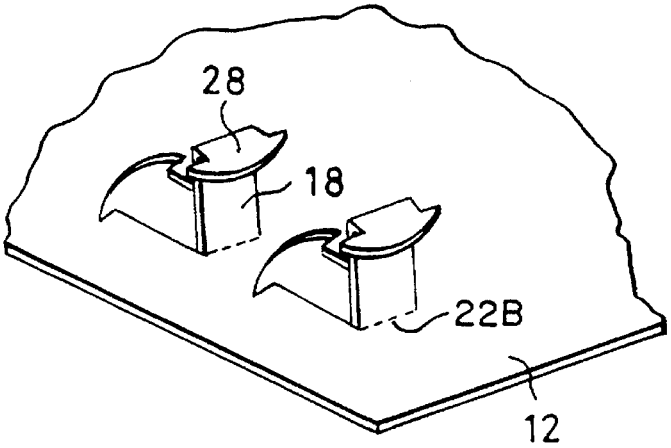
FIG.5B.
FIG.5C.
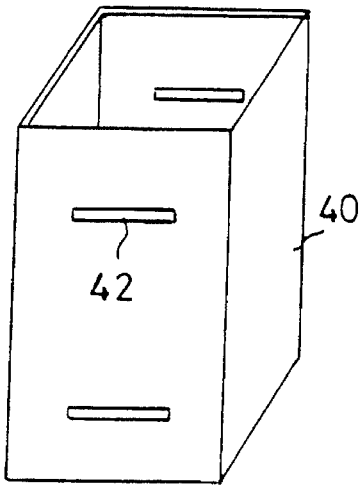

PALLET

This invention relates to pallets for supporting cargoes during transportation, shipment and storage.

A pallet is an apparatus widely used to transport cargoes from one place to another. The idea of a pallet is to facilitate cargo shipment or delivery in an easy and safe manner. There is a wide range of pallets available with different characteristics adapted to the type of cargoes to be transported. Pallets have long been used for the transportation and storage of various merchandise.

Lately, such pallet structures have become increasingly sophisticated to meet varying standards and demands. In the past, pallets have commonly been constructed from a rigid material namely wood. Such pallets, however, are relatively heavy, bulky and expensive. Therefore in general all paper materials are much more suitable and cheaper for the construction of such pallets. Furthermore, wooden pallets are mainly interconnected by adhesive substances, nails or metal wire stitches that pose great disadvantages during the recycling process. Because of their separate components, such pallets can be very heavy and expensive.

It is an object of the invention to seek to overcome these disadvantages.

Thus according to a first aspect of the invention there is provided a pallet comprising a first sheet member and a second sheet member, and a plurality of spacer elements between the sheet members characterised by the sheet members and spacer elements each having complementary locking means which comprise interengageable tongues and slots respectively carried by the members or elements and each tongue comprising at least one flange for securing the member or element on insertion through the slot. It is preferred that the flange is substantially wider than the slot, and that the flange comprises at least one ear within the plane of the tongue. The flange may be in the form of any geometric shape and preferably will have a D-shape. Each tongue is preferably substantially rectangular.

According to a first aspect of the invention it is provided that the sheet members comprise the tongues and the spacer elements comprise the slots. The tongues may extend out of the plane of said sheet members and may be arranged in pairs or in groups of four. The flanges of the tongues may extend substantially towards each other or away from each other, and the tongues may extend out of the plane of said sheet members in substantially the same direction or in opposite directions. The slots in the spacer elements are preferably substantially perpendicular to the sheet members or substantially parallel with the sheet members and it is most preferred that they are parallel with one another.

According to a second aspect of the invention it is provided that the sheet members comprise the slots and the spacer elements comprise the tongues. Thus the sheet members may comprise a plurality of hinged flaps, the sheet members comprising at least one slot adjacent to and parallel with each of said flaps, and adapted to receive a tongue extending from a spacer element, and by said spacer elements comprising at least one tongue comprising at least one flange disposed to engage said slot.

Alternatively the sheet members may comprise a plurality of pairs of slots, each slot arranged substantially parallel to its pair and each pair comprising a first slot and a second slot, wherein said first slot is longer than said second slot, and by said spacer elements comprising a plurality of tongues comprising at least one flange, each of said tongues disposed to pass through said first slot and then through said second slot.

It is preferred that the spacer elements referred to hereinbefore further comprise locating studs disposed to engage corresponding holes in said sheet elements.

It is also preferred that either or both of the sheet elements further comprise hinged wall extensions.

According to a further aspect of the invention there is provided a kit for assembly of a pallet comprising a first sheet member and a second sheet member, and a plurality of spacer elements between the sheet members, characterised by the sheet members and spacer elements each having complementary locking means which comprise interengageable tongues and slots respectively carried by the members or elements and each tongue comprising at least one flange which secures the member or element on insertion through the slot, whereby to form a pallet.

The principle object of the present invention is thus to have a pallet which may be easily assembled and which may consist of a minimal number of unitary part and yet may retain the same configuration, rigidity and strength of existing wooden or paper pallets. This object is achieved because the pallets of the invention comprise three unitary parts namely first and second sheets and multiple inner legs. Pallets according to the present invention may be assembled easily by way of "slot in" locking means without using any added materials such as glue, nails, metal wire stitches or any other adhesive substance.

A further object of the present invention is to provide pallets which are environmentally friendly and easily recycled. This object is achieved as suitable materials to be used are for example corrugated fibreboard, solid paperboard, paper material or any other material which is biodegradable or recyclable. Furthermore, the present invention may be made up entirely of paper material without the use of any nails or metal wire stitches so that there is no difficulty in sorting out materials for recycling.

A further object of the present invention is to provide an inexpensive and lightweight pallet. This object is achieved as the suggested materials for use in construction of the pallets are inexpensive and very light in weight, so that tremendous savings can also be achieved in the cost of transportation or distribution, especially when using airfreight cargo.

A still further object of the present invention is to provide a pallet that is variable in size and thickness, but has the configuration of an ordinary pallet so that lifting and moving the pallet with cargo can be done by an ordinary forklift truck. Thus avoiding unnecessary modification on the forklift truck. Unlike conventional pallets, all of which have nine legs, the number of legs in the present invention can be varied according to the size of the invention.

The present invention may comprise an upper and lower sheet with multiple inner legs to give strong and ideal support for cargoes. The upper sheet and lower sheet are joined together by means of inner legs to give strong and ideal support for cargoes. These inner legs are locked to the upper and lower sheet by way of "slot in" locking means so that a perfect pallet can be constructed. The present invention can be coated or impregnated with wax or chemical in order to make it water resistant.

The present invention will become more fully understood from the detailed description given hereinbelow, and by the examples of alternative "slot in" locking means for pallets made in accordance with the present invention. Reference will be made to the accompanying drawings in which:

FIGS. 5A, 5B & 5C show a particular cutting arrangement of tongues and flanges together with a spacer element with corresponding slots;

Figure 1:
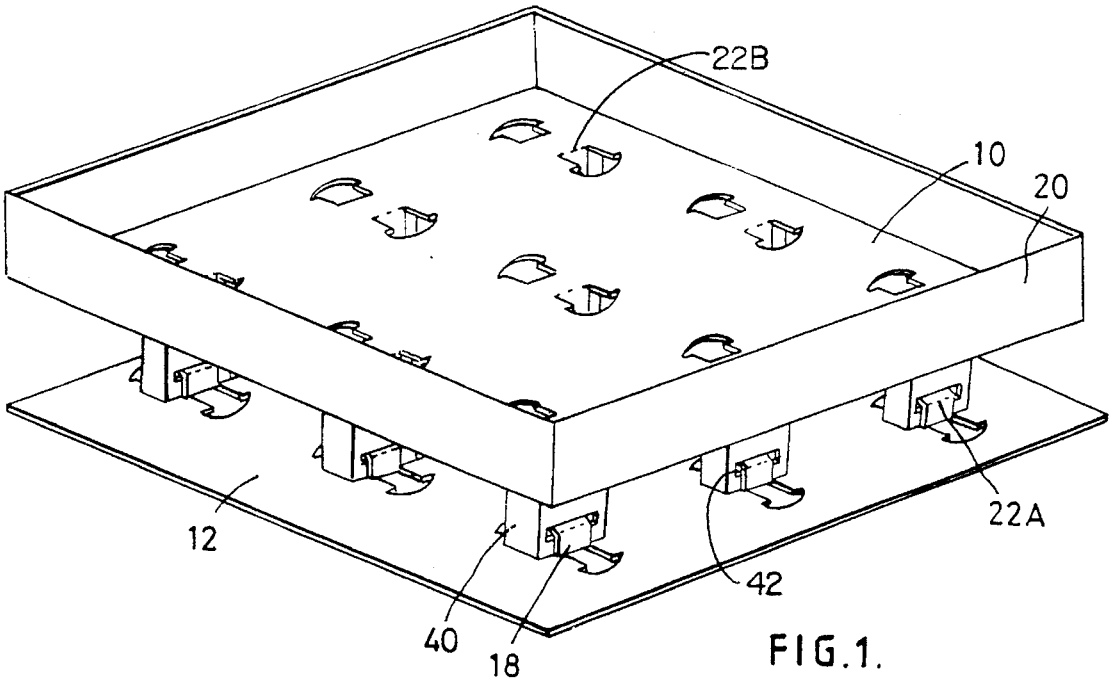
FIG. 1 shows an assembled paper pallet of the present invention with upper side wall.

Referring to FIGS. 1, 2A, 2B, 2C & 2D, there are shown several views of pallets and components therefor according to the present invention. The first sheet (10) and second sheet (12) may consist of tongues (18) and flanges (28) to be secured with the spacer elements (40) to form the pallets as a unitary structure. The tongues (18) may consist of a pair of crease lines (22A, 22B) and at least a flange (28). The spacer elements (40) may comprise slots (42) to receive the flanges (28) so that together the tongues (18) and flanges (28) provide a locking mechanism for the first and second sheets (10, 12) with the spacer elements (40).

Each flange (28) may first be folded perpendicularly to the tongue (18) along the crease line (22A). The flange (28) may then be forced through a slot (42) by bending the tongue (18) along crease line (22B) and allowing the flange (28) to be caught behind the walls adjacent the slots (42) inside the spacer element (40) as shown in FIG. 2C. This securing and locking mechanism reduces movement of the spacer elements (40) thus strengthening the pallets.

Figure 2A:
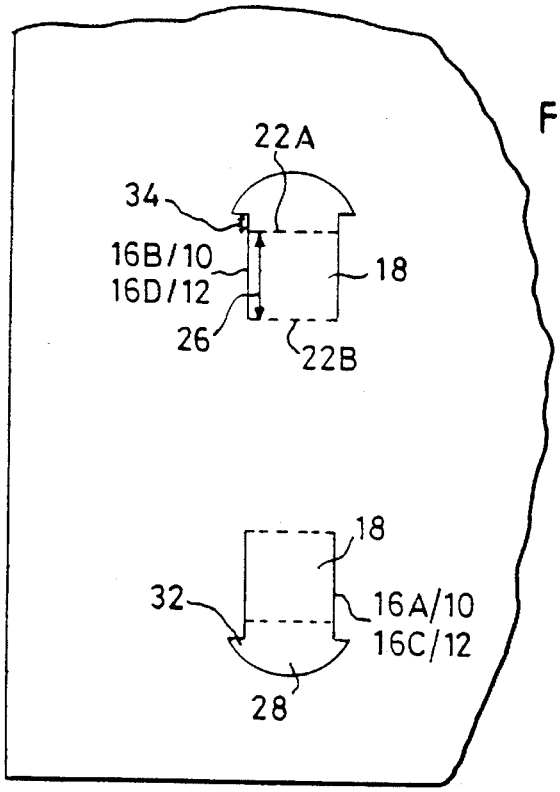
FIG. 2A illustrates a plan view of crease lines for forming tongues and flanges.
Figure 2B:
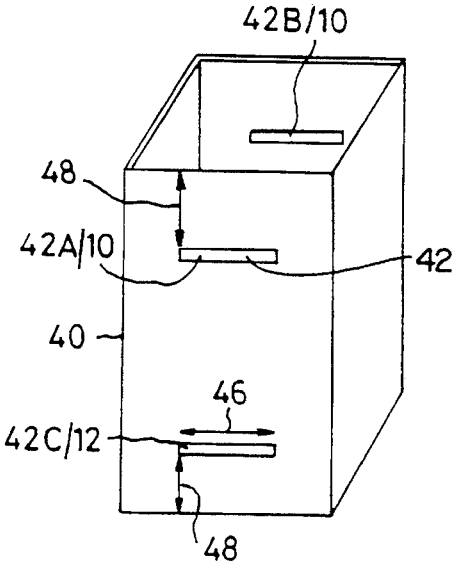
FIG. 2B shows a spacer element with slots disposed to correspond to the flanges shown in FIG. 2A.
Figure 2C:
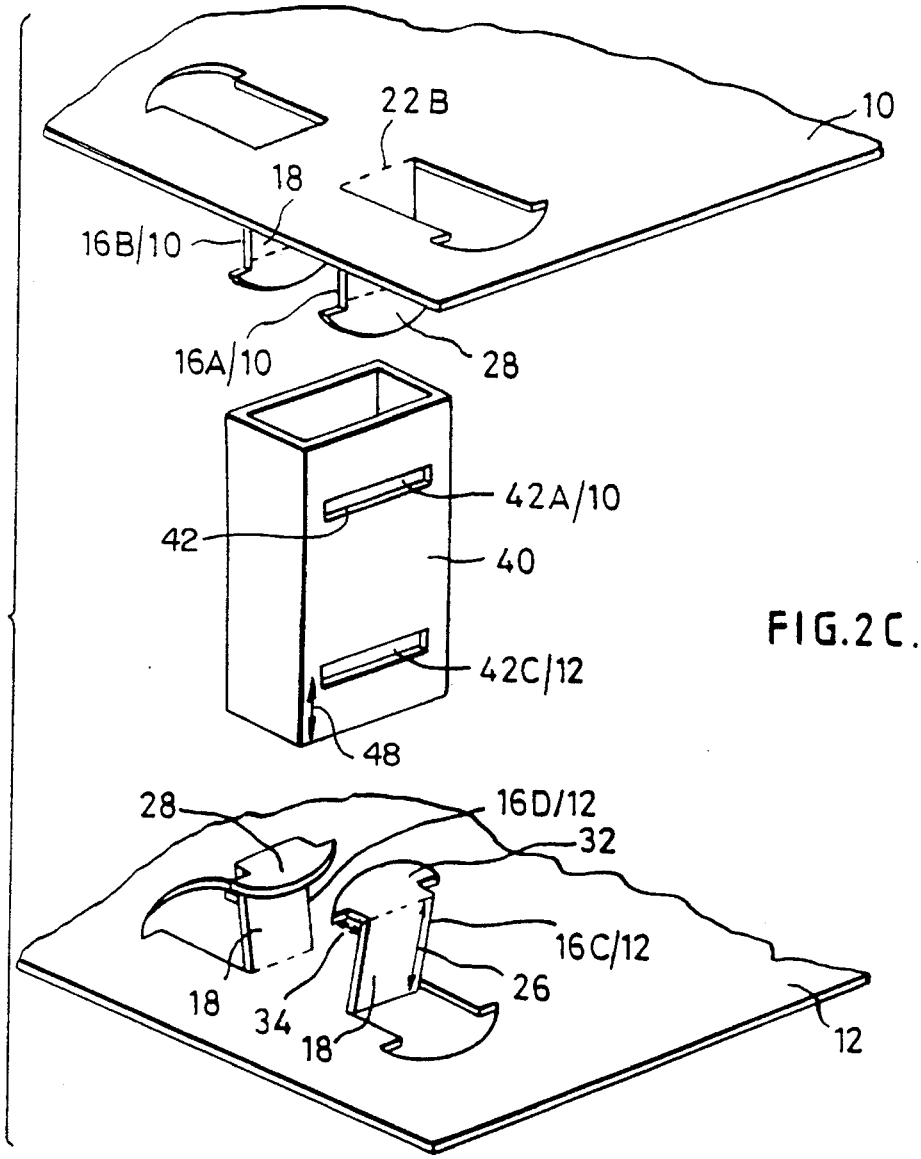
FIG. 2C illustrates a view of a spacer element in position to receive "slot in" locking means (i.e. Flanges and slots)
Figure 2D:
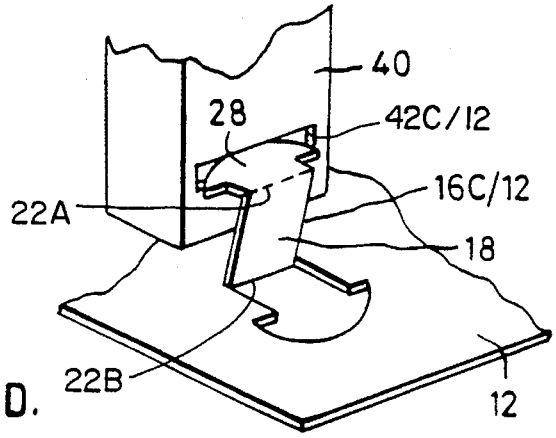
FIG. 2D shows a particular form of "slot in" locking means.
Figure 3:
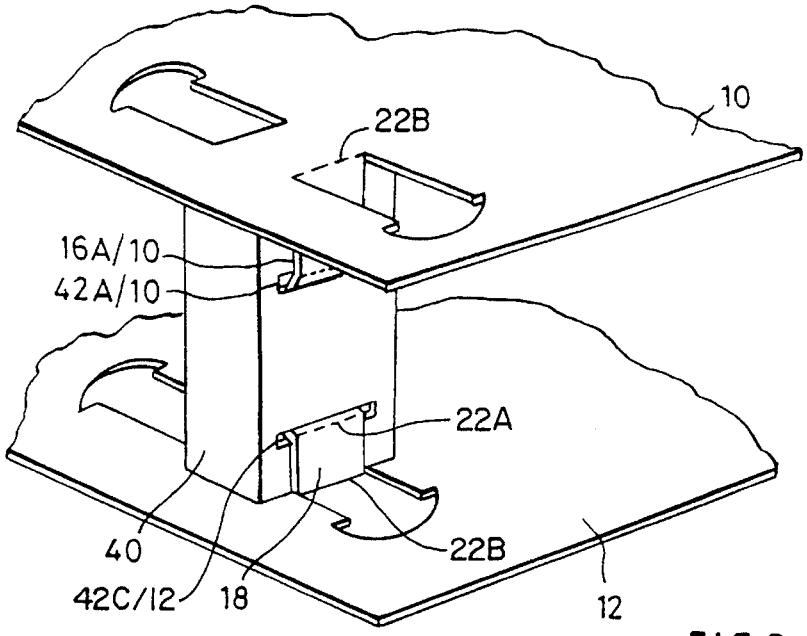
FIG. 3 shows a spacer element in position.
Figure 4:
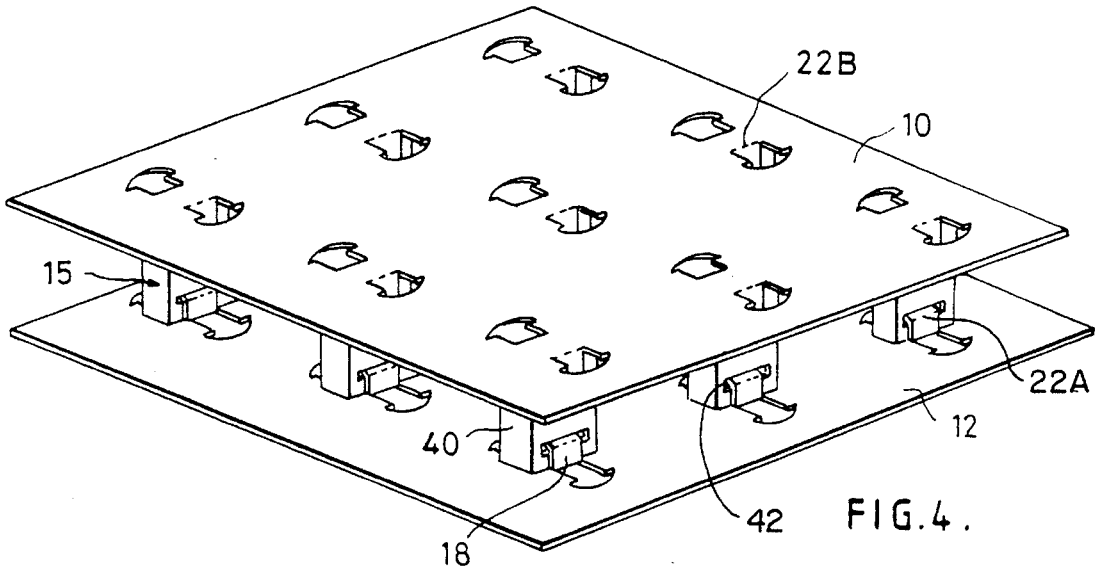
FIG. 4 shows a completely assembled pallet according to one aspect of the invention.

For instance, referring to FIGS. 2C and 2D, the flange (28) namely 16C/12 from the second sheet (12) is secured into its respective slot namely 42C/12. The flange (28) from the first sheet (10) namely 16A/10 is secured into its respective slot namely 42A/10 and so on. The flanges (28) may be designed and configured with rounded or tapered ends to facilitate entry into the slots (42). When all the flanges (28) are fully engaged with their slots (42), the spacer element (40) will be held firmly in position.

The distance (48) of the slot (42) from the edge of the spacer element (40) may correspond to the length (26) of the tongue (18) in order to ensure that the said tongue (18) will pull the first sheet (10) and second sheet (12) towards the spacer element (40). In addition, the gap (34) between the crease line (22A) and the ear (32) of the flange (28) is preferably slightly more than the thickness of the wall of the spacer element (40).

FIG. 5A shows the flanges (28) cut in series (same direction) instead of opposite each other as shown in FIG. 2A. FIG. 5B shows the flanges (28) in a bent position and FIG. 5C shows a spacer element (40) with slots (42).

Figure 6A:
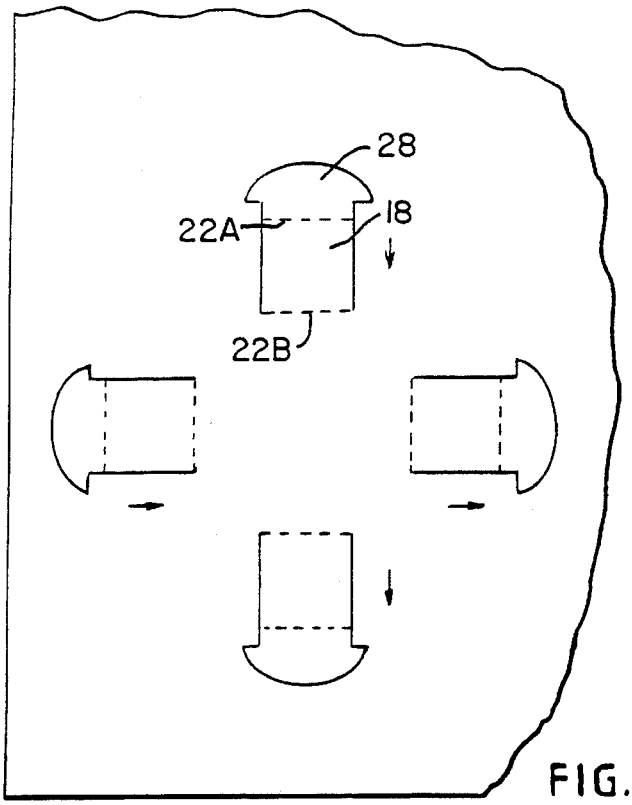
FIGS. 6A & 6B show the plan and perspective view of an alternative cutting arrangement of tongues and flanges together with a spacer element with corresponding slots.
Figure 6B:
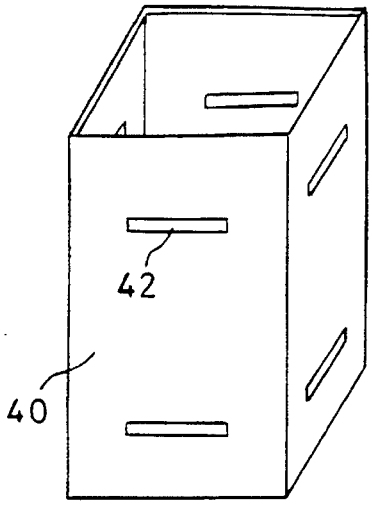

FIG. 6A shows a particular arrangement of four tongues (18) which are arranged in a square configuration. The arrows indicate one particular way in which a spacer element (40) may be attached.

In general, a material made of multiple layers of paper wound together or any other similar material may be used to construct the spacer elements (40).

Figure 7A:
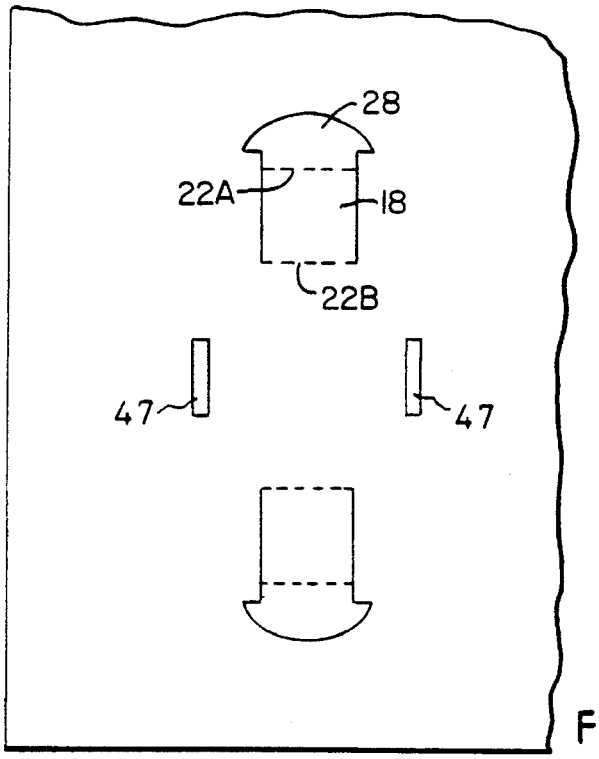
FIG. 7A illustrates the arrangement shown in FIG. 2A with additional stud slots.
Figure 7B:
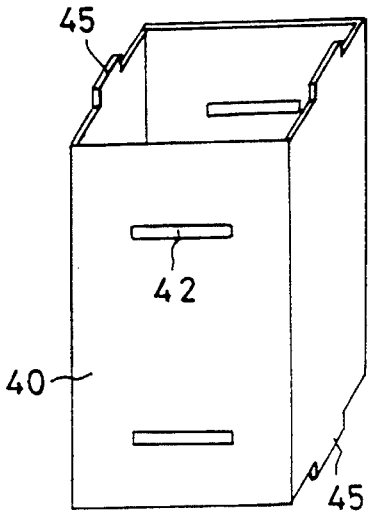
FIG. 7B illustrates a spacer element for the arrangement of FIG. 7A, showing the positions of corresponding studs for the stud slots.
Figure 8A:
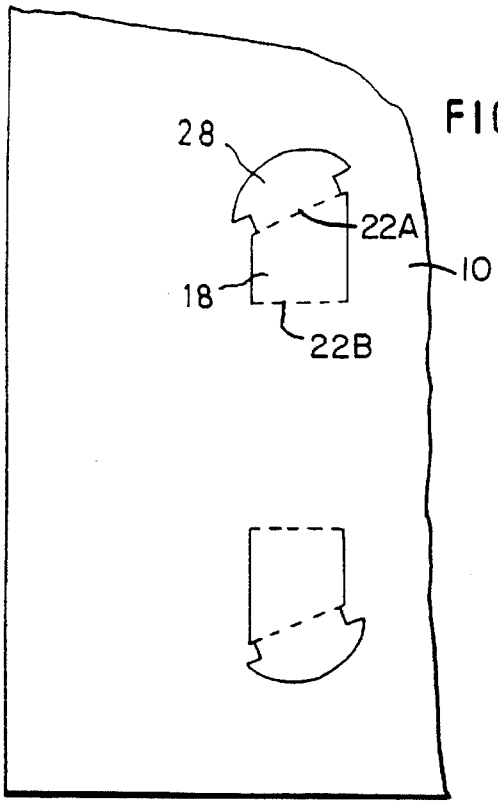
FIGS. 8A, 8B, 8C and 8D illustrate a plan, perspective and side elevational views of a further alternative cutting arrangement, showing slanting flanges and a corresponding spacer element with slanting slots in various alternative configurations.
Figure 8B:
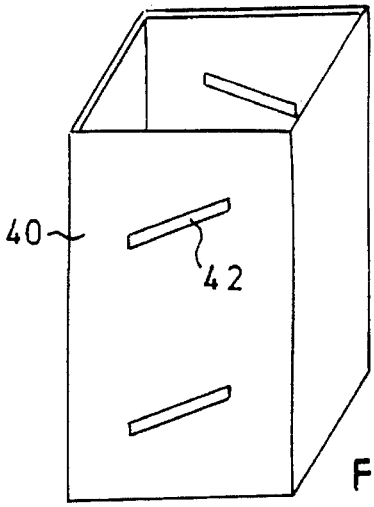
Figure 8C:
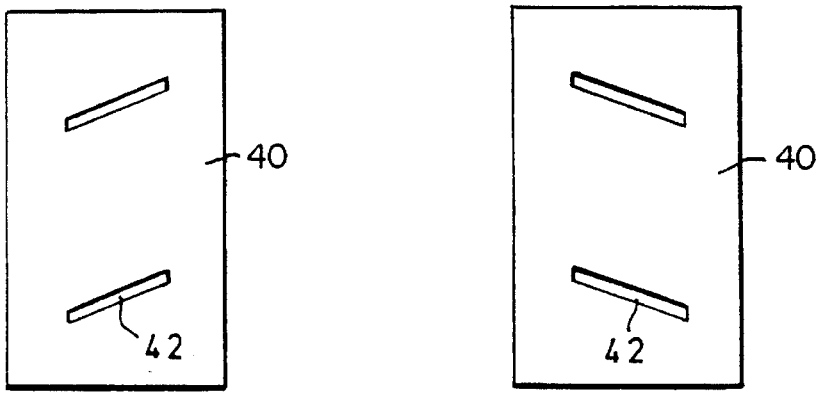
Figure 8D:
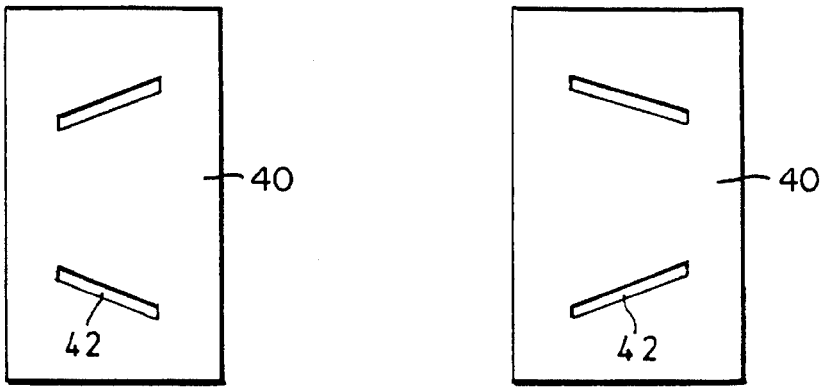

Alternatively, or additionally, the pallet can be provided with at least one pair of studs (45) on each of the spacer elements (40) as shown in FIGS. 7A and 7B. These studs (45) are inserted into corresponding stud slots (47) in the first (10) and/or second (12) sheets. The purpose of the said studs (45) is to locate the space element (40) and reduce movement between the spacer elements (40) and first and second sheets (10, 12).

FIGS. 8A, 8B, 8C & 8D show that the flanges (28) can be configured in a slanting manner with correspondingly slanted slots (42).

Referring to FIGS. 9A, 9B, 9C, 9D & 9E, a locking mechanism is illustrated comprising modified flanges (60) and modified slots (56). These modified flanges (60) have two additional crease lines (52) together with flange sides (54) to facilitate the "slot in" mechanism.

For instance, the modified flanges (60A/10) and (60B/10) from the first sheet (10) are appropriately inserted into the modified slots (56) namely 56A/10 and 56B/10. Similarly, the modified flanges from the second sheet (12) are appropriately inserted into the modified slots namely 56C/12 (not shown) and 56D/12. Each modified slot (56) incorporates at least one angled section (58). The sides (54) of the flanges (60A/10 & 60B/10) are bent according to the angled section (58) of the modified slot (56) to facilitate the easy entry of the modified flange (60). Hence, when these modified flanges (60) are fully inserted into the modified slots (56) the flange sides (54) will normally return substantially to their original plane, causing the flange sides (54) to be caught behind the adjacent walls of the modified slots (56). When all the modified flanges (60) are fully engaged with the modified slots (56), the inner core will be held firmly in position to form one of the spacer elements (40).

Figure 9A:
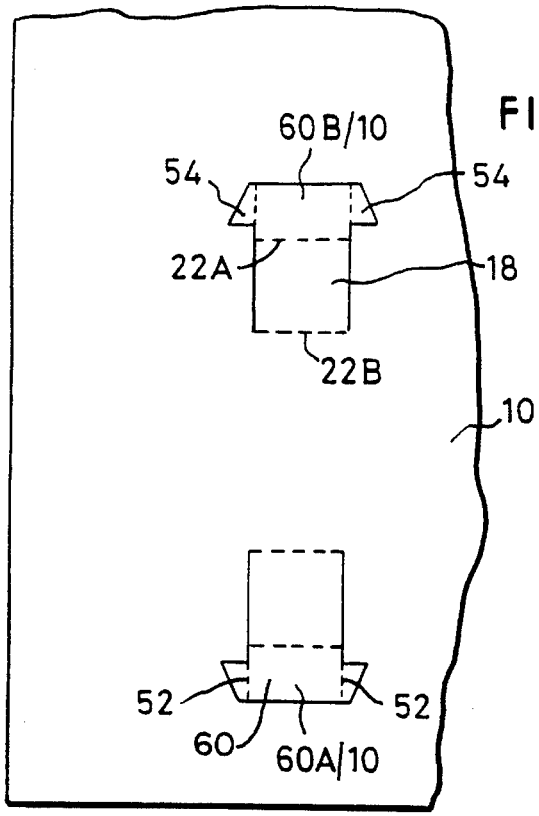
FIG. 9A illustrates a plan view of modified flanges for another arrangement of slots.
Figure 9B:
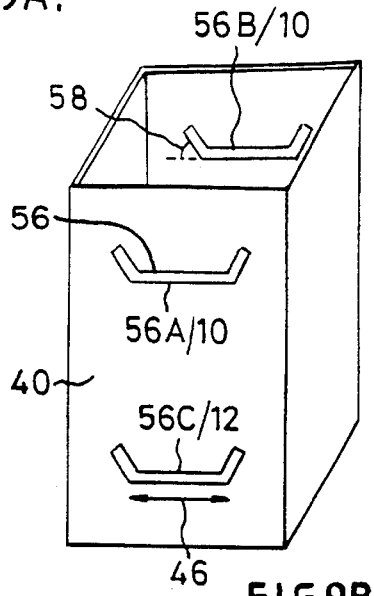
FIGS. 9B, 9C, 9D & 9E illustrate perspective views of spacer elements showing several arrangements of slots corresponding to the modified flanges in FIG. 9A.
Figure 9C:
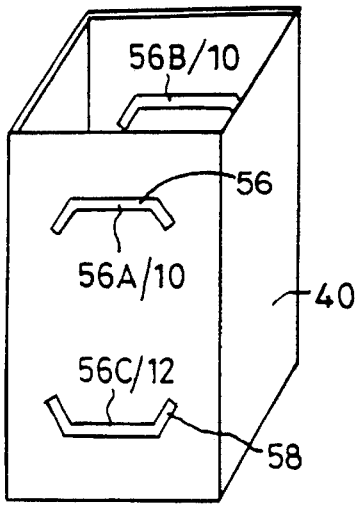
Figure 9D:
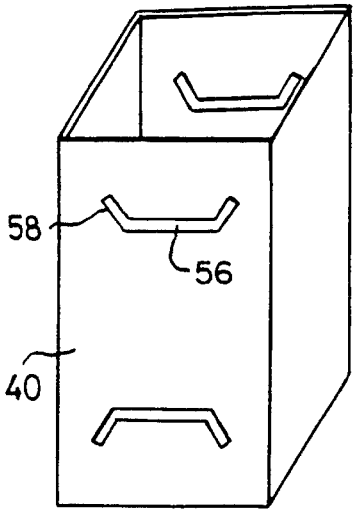
Figure 9E:
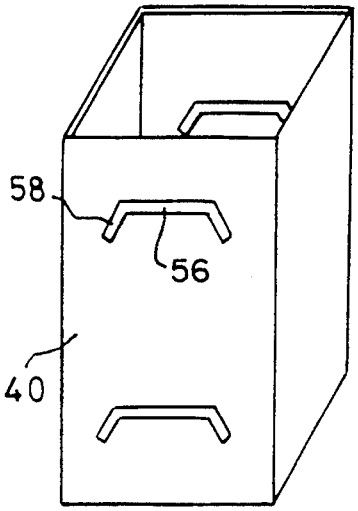

The inner spacer elements (40) which comprise four modified slots (56) can be designed in several ways such as are shown in FIGS. 9C, 9D and 9E. The angled section (58) of the modified slots (56) could for example be configured in a number of ways as shown. The modified flanges (60) are then designed according to the particular configuration of the modified slots (56).

Figure 10A:
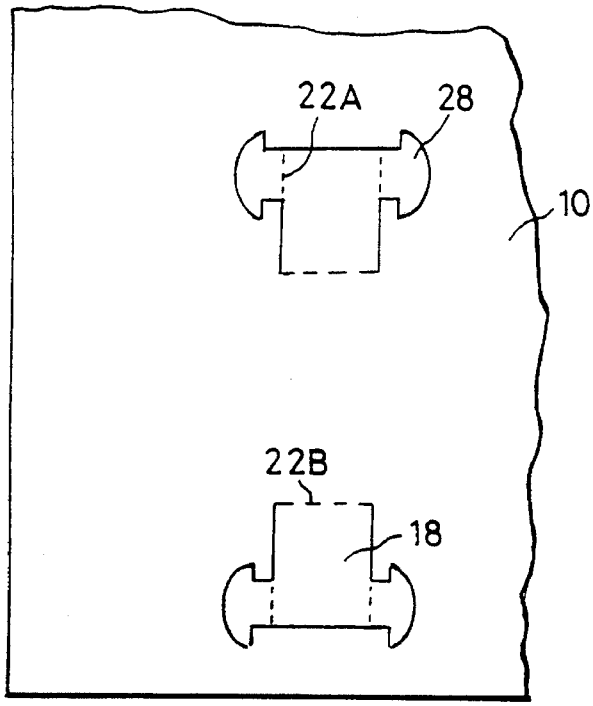
FIG. 10A illustrates a plan view of an alternative arrangement of tongues and flanges.
Figure 10B:
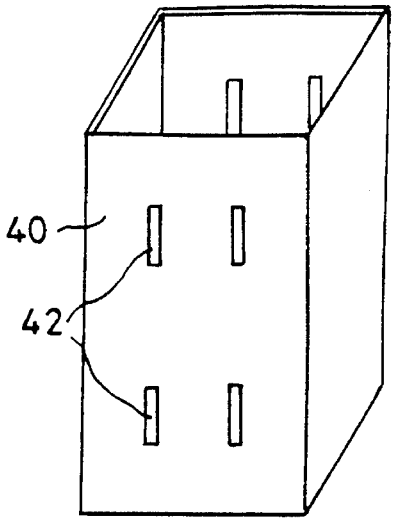
FIG. 10B illustrates a perspective view of a spacer element showing slots corresponding to the flanges in FIG. 10A.
Figure 10C:
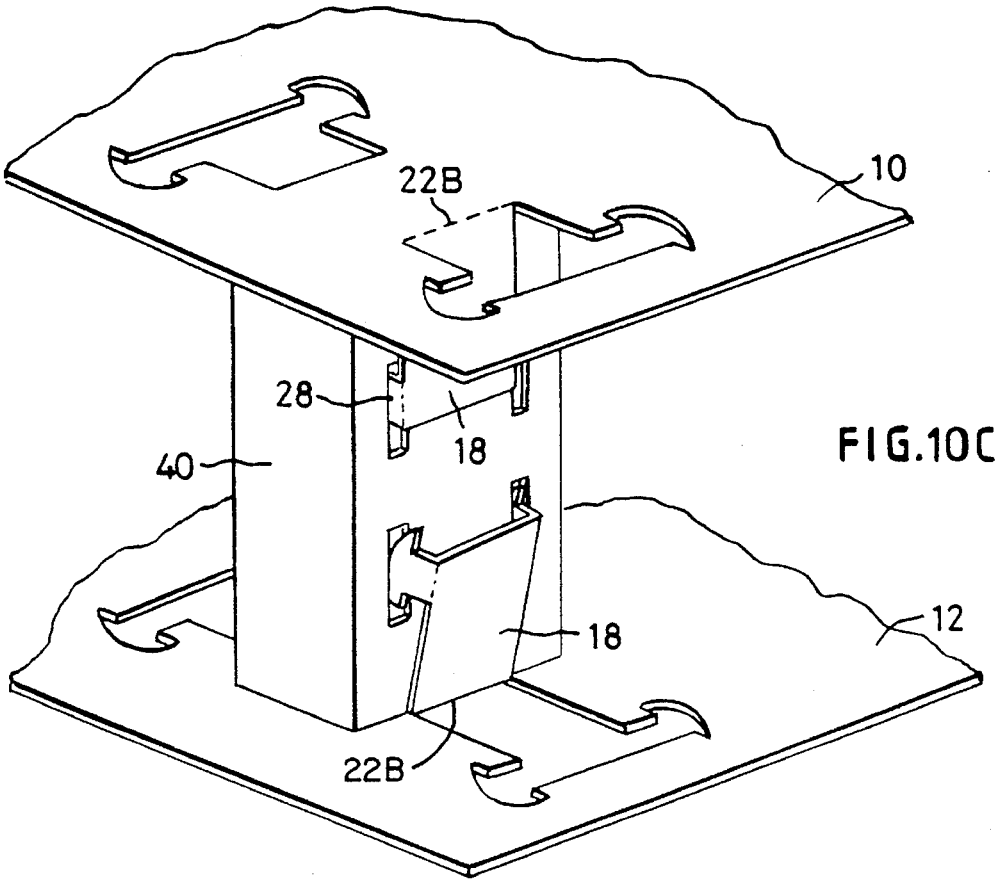
FIG. 10C illustrates an assembled spacer element of the arrangement as shown in FIGS. 10A & 10B.

FIGS. 10A, 10B and 10C show an arrangement including vertical slots (42). It will be noted that the first sheet (10) may comprise tongues including two flanges (28) which may be folded along crease lines (22A) towards one another and which engage with correspondingly positioned slots (42) in the spacer element (40). Similarly, all the eight flanges (28) can be attached to the spacer element (40). Tongues (18) are folded from the first and second sheets (10, 12) along the crease lines (22B). Then the flanges (28) are folded along crease lines (22A) and forced into the corresponding slots (42). Although, as it will be appreciated, the positions of the tongues (18) relative to each other must be maintained in order to achieve a satisfactory engagement with the spacer elements (40), the positions of the tongues (18) in the sheets (10, 12) may be varied as required.

Figure 11A:
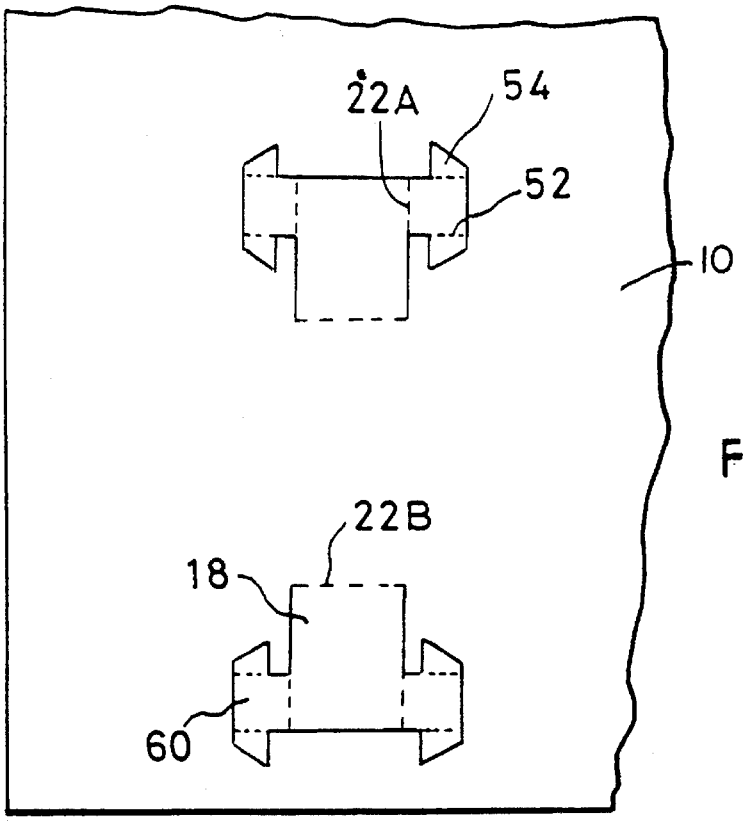
FIGS. 11A & 11B illustrate a plan view of a further alternative arrangement of flanges and a perspective view of a corresponding spacer element.
Figure 11B:
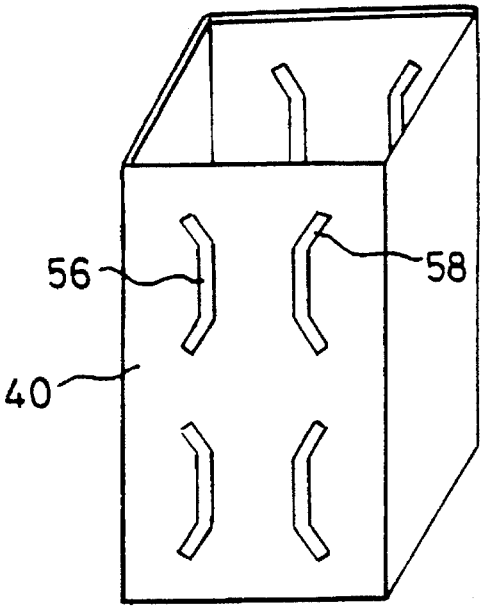
Figure 12A:
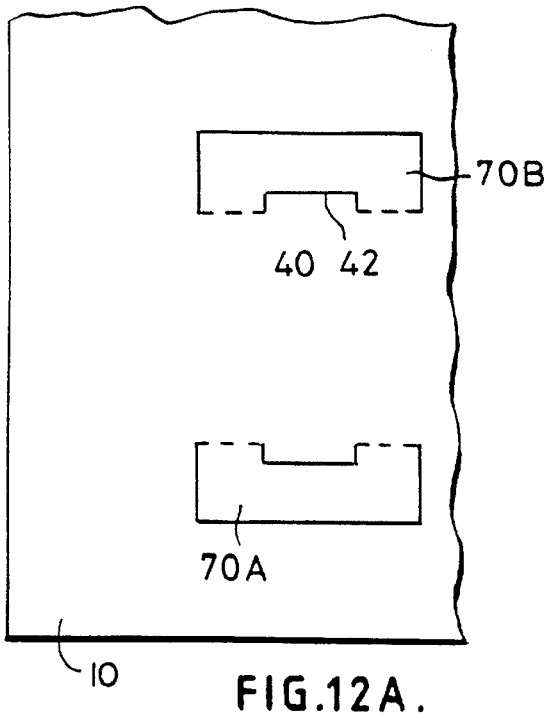
FIGS. 12A & 12B illustrate a plan view of an alternative arrangement wherein slots are cut in the sheets.
Figure 12B:
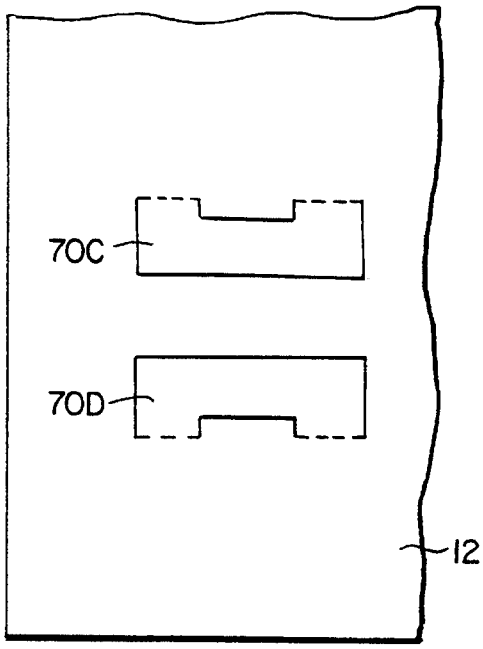
Figure 12C:
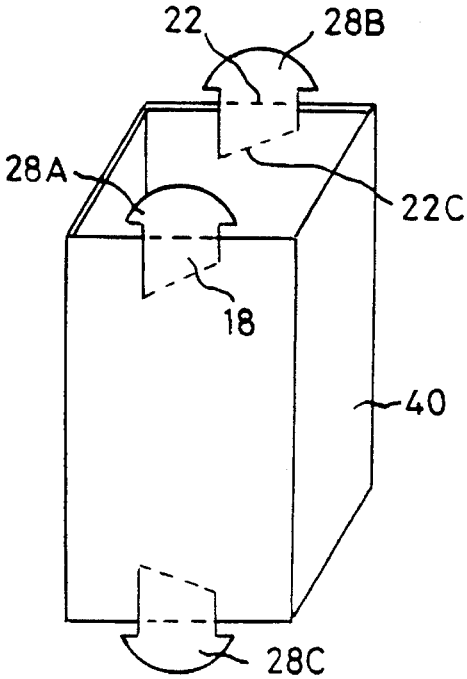
FIG. 12C illustrates a perspective view of a spacer element with tongues and flanges corresponding to the slots shown in FIGS. 12A & 12B.
Figure 12D:
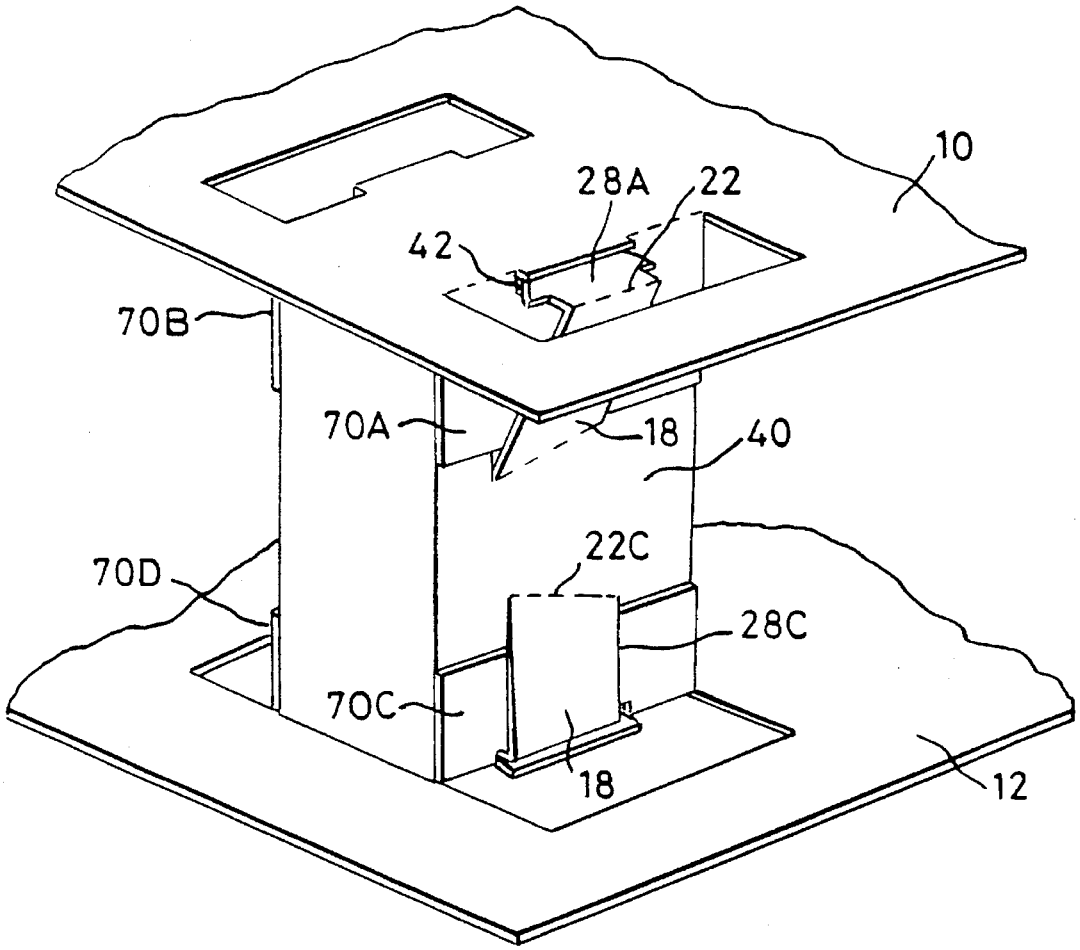
FIG. 12D shows the assembled spacer element of FIGS. 12A, 12B & 12C.

A further advantageous embodiment wherein the locking mechanism is modified to have two extra crease lines (52) on each modified flange (60) is illustrated in FIGS. 11A and 11B.

Referring to FIGS. 12A, 12B, 12C and 12D, it may be seen than an alternative embodiment of the present invention may comprise top flaps (70A, 70B) and bottom flaps (70C, 70D) formed respectively from the first and second sheets (10, 12). In this embodiment two flanges (28A, 28B) cut from a spacer element (40) are folded along the crease line (22) perpendicular to the tongue (18) before folding the slanting crease line (22C) to facilitate parallel entry of the flanges (**28*a*, 28*b*) into the slots (42) of flaps (70A, 70B). The other two flaps are then attached in a similar position, and the process is repeated for each of the spacer elements (40**) of the pallet.

Figure 13A:
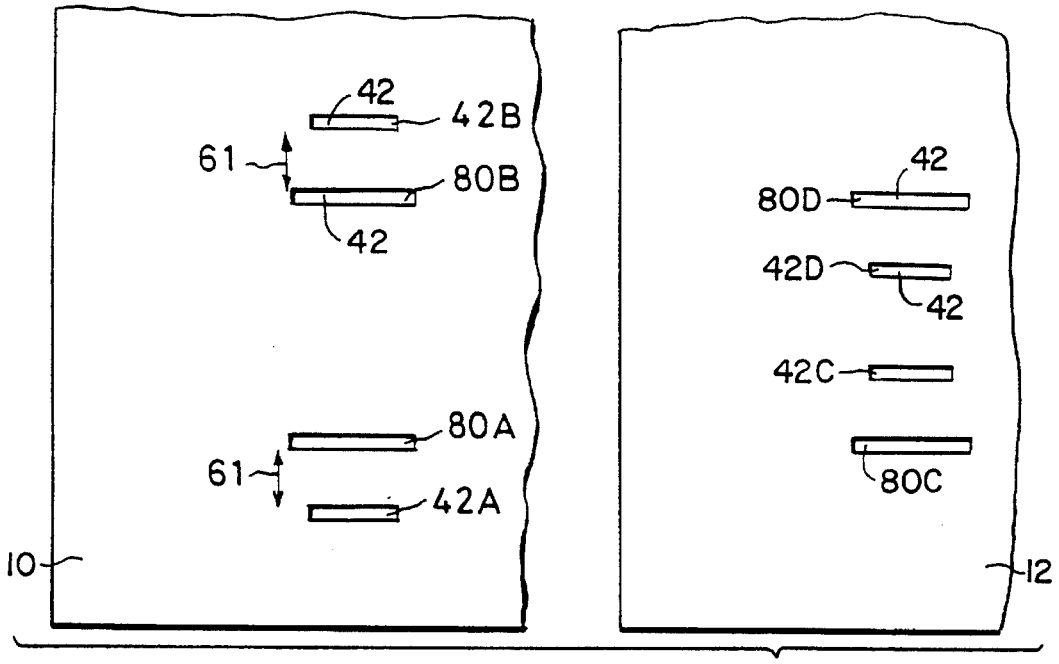
FIG. 13A illustrates a plan view of an upper sheet showing an alternative arrangement of slots.
Figure 13B:
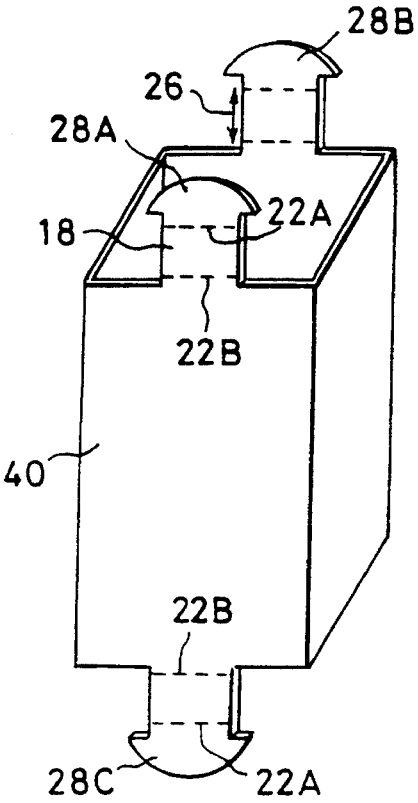
FIG. 13B illustrates a perspective view of a spacer element with tongues and flanges corresponding to the slots shown in FIG. 13A.
Figure 13C:
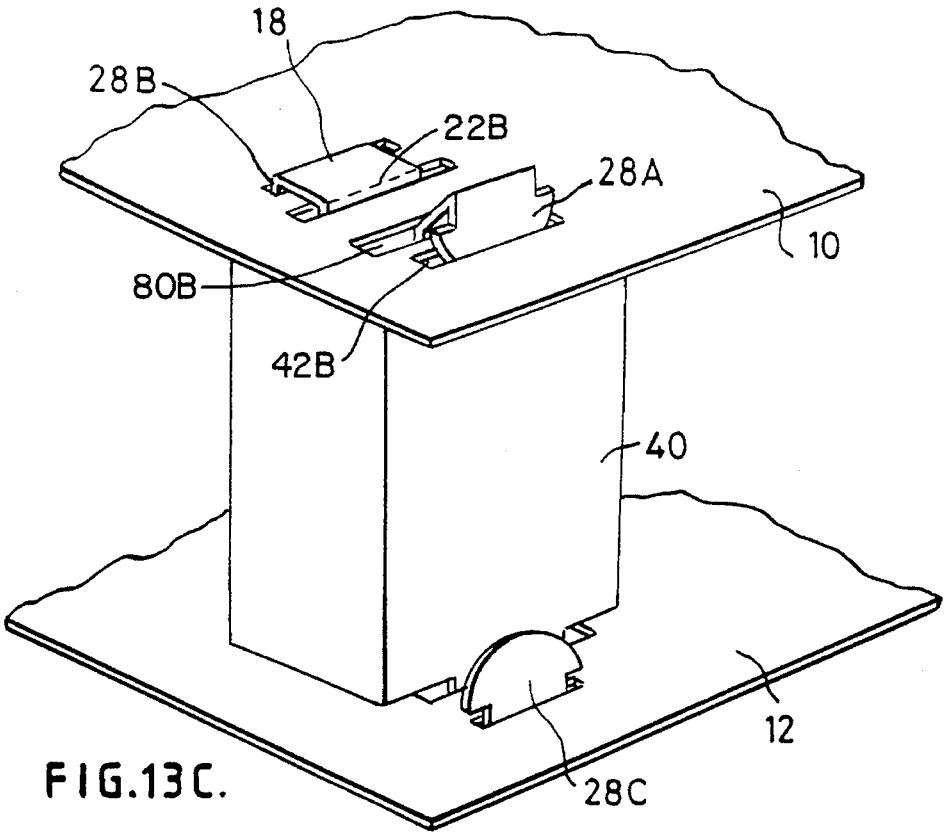
FIG. 13C illustrates an assembled spacer element of the arrangement shown in FIGS. 13A & 13B.

Referring to FIGS. 13A, 13B and 13C, there is shown a construction wherein the slots (42) are formed in the first and second sheets (10, 12). These slots may be formed in two different sizes one being longer than the other. For assembly, the flange (28A) is first inserted into the slot (80A) and then folded along the crease line (22B). Finally, the flange (28A) is folded along the second crease line (22A) before being inserted into the slot (42A). The operation is repeated for the other spacer elements (40) to form the pallet. Alternatively the slots (42) can be configured by locating the smaller slots (42) adjacent each other as shown in FIG. 13A.

Figure 14:
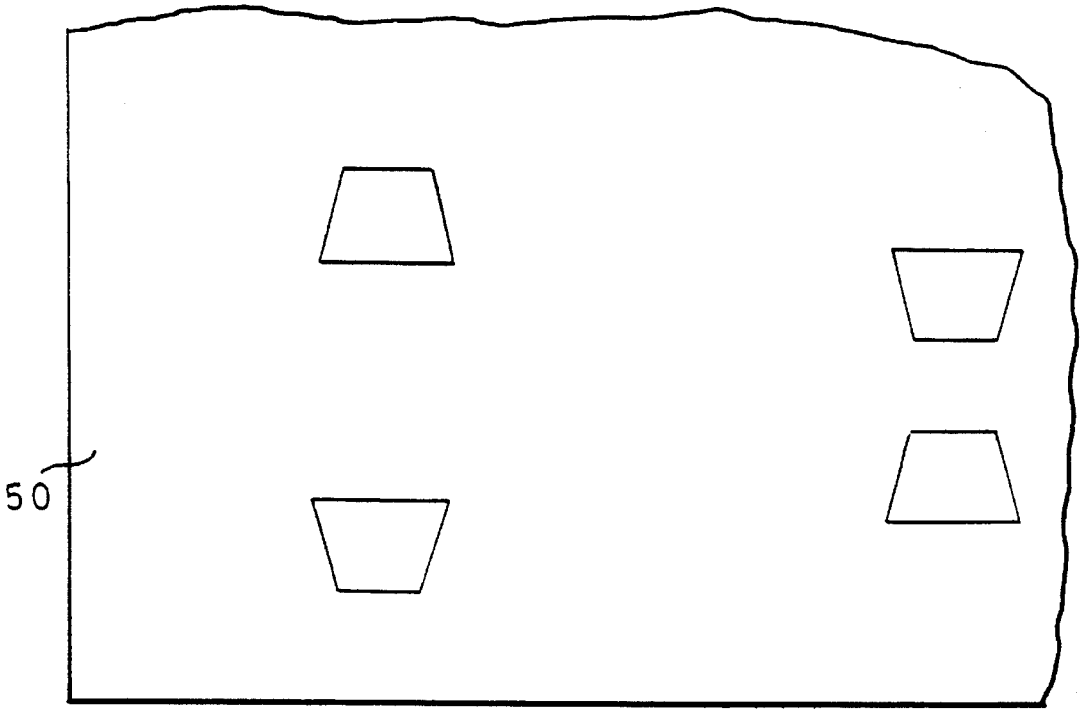
FIG. 14 illustrates one part of an extra sheet which can be placed on top of pallets according to the invention.

In this arrangement the space element (40) is firmly held by means of the "slot in" mechanism. The distance (61) between the smaller and longer slots (42A, 80A) will preferably correspond with the length (26) of the tongue (18) in order to reduce movement within the construction. When all the slots, (42A, 42B, 42C and 42D) are fully engaged, the spacer element (40) will be secured in position. An additional die cut sheet (50) (shown in FIG. 14) may be placed on top of the upper sheet (10) to provide a flat surface.

Figure 15:
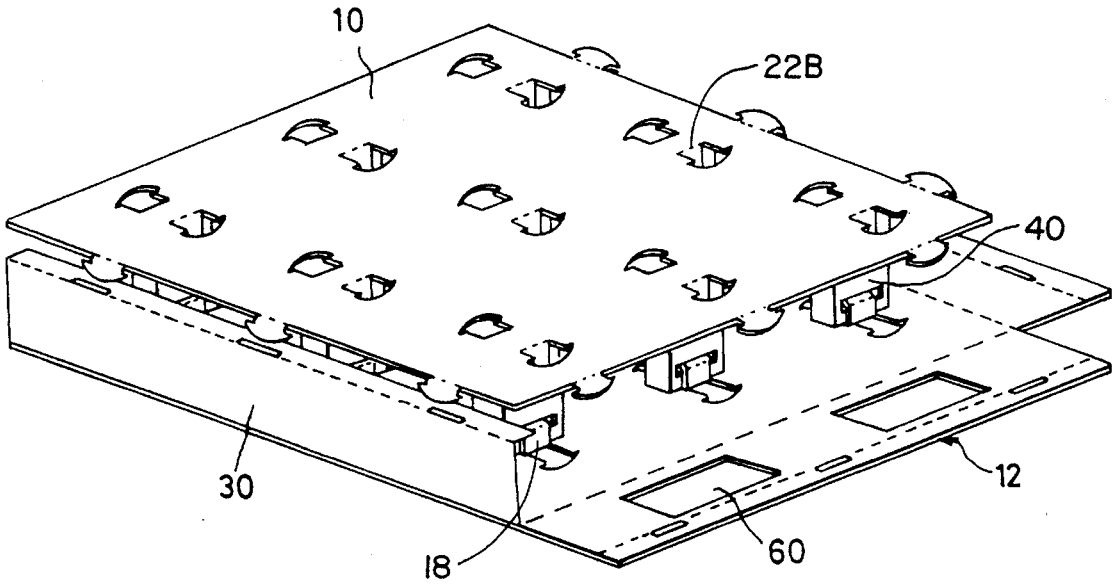
FIG. 15 illustrates an assembled paper pallet with a bottom side wall to conceal all the spacer elements and with fork lift holes.

Referring now to FIG. 15, a fully assembled pallet is shown having bottom side walls (30) to conceal all the spacer elements (40), and fork lift holes (60). The purpose of these fork lift holes (60) is to allow the pallet to be moved easily by mechanised equipment such as fork lift trucks.

It will be appreciated that in all of the embodiments hereinbefore described, it is advantageous that the width of a flange (28) is greater than the width of the corresponding slot (42) through which it is designed to fit. Thus, when a flange (28) with ears (32) is secured in a slot (42), the ears (32) are secured behind the material defining the slot (42) rendering the flanges substantially unretractable, thereby forming a solid and stable pallet.

I claim:

1. A pallet comprising:

first and second sheet members (10, 12);

spacer elements (40) between the sheet members;

said first and second sheet members and said spacer elements all being made of like materials;

interengageable tongues (18) and slots (42) formed by respective ones of the sheet members and spacer elements, said tongues being inserted through corresponding ones of said slots to secure the sheet members and the spacer elements together;

said tongues including flanges (28) with ears (32) so said flanges are substantially wider than said slots to help keep said tongues interengaged with said slots; and said tongues (18) and slots (42) being arranged in groups of four for each said spacer element.

2. A pallet according to claim 1, characterized by said flange (28) comprising a geometric shape.

3. A pallet according to claim 1, characterized by said flanges (28) being substantially D-shaped.

4. A pallet according to claim 1, characterized by said tongues (18) being substantially rectangular.

5. A pallet according to claim 1, characterized by said spacer elements comprising said slots, said slots (42) in said spacer elements (40) being substantially parallel to said sheet members (10, 12).

6. A pallet according to claim 1, characterized by said slots (42) being substantially parallel to one another.

7. A pallet according to claim 5, characterized by the length (26) of each said tongues (18) corresponding substantially with the distance (48) between a respective said slot (42) and the edge of said spacer element (40).

8. A pallet comprising a first sheet member (10) and a second sheet member (12), and a plurality of spacer elements (40) between the sheet members (10, 12), characterized by the sheet members (10, 12) comprising slots (42) and spacer elements (40) comprising tongues (18), said tongues (18) and slots (42) being interengageable, each said tongue (18) comprising at least one flange (28) for securing the member (10, 12) on insertion through the slot (42), said sheet members (10, 12) comprising hinged flaps (70 A–D) extending from each of said sheet members (10, 12) by a hinge, said slots (42) adjacent to and parallel with said hinges, said slots adapted to receive said tongues (18) extending from said spacer element (40).

9. A pallet comprising:

first and second sheet members (10, 12);

spacer elements (40) between the sheet members;

interengageable tongues (18) and slots (42) formed by the sheet members and spacer elements, said tongues being inserted through corresponding ones of said slots to secure the sheet members and the spacer elements together;

said tongues including flanges (28) with ears (32) so said flanges are substantially wider than said slots to help keep said tongues interengaged with said slots;

a plurality of said spacer elements each being coupled to said first sheet by four of said interengageable tongues and slots and being coupled to said second sheets by four of said interengageable tongues and slots.

* * * * *